United States Patent [19]

Dale et al.

[11] Patent Number: 5,064,386

[45] Date of Patent: Nov. 12, 1991

[54] CONVENIENCE ELECTRICAL OUTLET ASSEMBLY

[75] Inventors: James L. Dale, Lawrenceville; Vernon R. Miller, Atlanta; Lincoln E. Roberts, Decatur, all of Ga.

[73] Assignee: AMP Incorporated, Harrisburg, Pa.

[21] Appl. No.: 618,766

[22] Filed: Nov. 27, 1990

[51] Int. Cl.[5] ..... H01R 13/60

[52] U.S. Cl. ..... 439/535; 220/3.5

[58] Field of Search ..... 435/535, 536, 538, 590, 435/560, 561; 220/3.5, 3.6; 174/58, 59; 248/87.1

[56] References Cited

U.S. PATENT DOCUMENTS 4,725,249 2/1988 Blackwood et al. ..... 439/535

4,756,695 7/1988 Lane et al. ..... 439/76

4,863,399 9/1989 Medlin ..... 439/538

4,899,217 2/1990 MacFadyen et al. ..... 358/86

*Primary Examiner*—Eugene F. Desmond

*Attorney, Agent, or Firm*—William B. Noll; Robert W. Pitts

[57] ABSTRACT

A convenience outlet assembly having a wall box which can be mounted relative to a stud in light frame construction is suitable for use with a hybrid cables containing both power and signal conductors. The assembly includes a mounting bracket attachable to a stud and a wall box which can be attached to the mounting bracket with a peripheral frame on the front of the wall box being precisely positioned relative to the exterior of a wall panel, even through the position of the mounting bracket can vary. A cable tap subassembly attachable to provided for interconnection of various modules in the assembly. This cable tape subassembly can be part of the rear wall of the housing.

20 Claims, 5 Drawing Sheets

CONVENIENCE ELECTRICAL OUTLET ASSEMBLY

FIELD OF THE INVENTION

This invention relates to a wall box outlet assembly for use with cables in a structure and more particularly relates to a convenience outlet assembly in which modules or outlets can be positioned for attachment to wires in a cable deployed in the structure, such as a hybrid ribbon cable suitable for use in an intelligent wiring system for a building.

DESCRIPTION OF THE PRIOR ART

In light frame structures, such as houses, wires are deployed prior to assembly of wall panels, such as drywall panels. Applicable codes require that wall or outlet boxes, which are part of the original wiring, must be secured to studs. Standard practice is for the boxes to be nailed to the studs at desired locations prior to positioning the drywall. The positions of the boxes are marked and holes, hopefully in alignment with the boxes are cut in the drywall. Afterwards outlets, switches and other components are attached to the wires and positioned within the outlet boxes. Faceplates or other covers are then assembled. Unfortunately, it is not always possible to insure that the depth at which the boxes are attached to the studs will be such that the faceplate will fit snugly with the exterior of the drywall panels. Subsequently installed boxes need not be attached to studs and oddly enough it is easier to mount these boxes flush with the exterior of the wall.

Although this problem is primarily one of aesthetics for conventional wiring, other problems have been encountered when multifunctional convenience outlet assemblies for so called intelligent wiring systems are considered. One example of an intelligent wiring system is shown in U.S. Pat. No. 4,899,217. These systems include both power conductors and data or signal conductors. Modules mounted in outlet boxes used in such systems include means for the attachment to both signal and power conductors. Because of the modular nature of such components, the insertion depth of the components must not vary too much in practical installations. If the cable is attached to a box attached to the stud, then a module inserted into the box after the drywall panels are installed may not properly engage the cable if the box is not precisely positioned relative to the exterior surface of the drywall. This is especially significant when the modules must provide of interconnection at the face of the outlet or in line with the faceplate, as for a duplex receptacle or an intelligent power outlet.

U.S. Pat. No. 4,756,695 discloses an outlet assembly which does not have this problem. That outlet assembly employs a frame to which cables having printed circuit board connectors are attached. The printed circuit board connectors are inserted into the frame from the rear. Modules or outlets having a printed circuit board interface are then inserted into the frame and into engagement with the printed circuit board connectors. This assembly allows for sufficient tolerance because the length of the pads on the printed circuit boards permits some leeway. This assembly is however intended to be a communications outlet assembly in which only data and signal communication outlets are to be positioned. This outlet assembly is also not specifically intended for use in light frame construction. Thus the problem of anchoring the frame to a stud with the frame subsequently misaligned relative to the surface of the wall panels is not generally encountered. U.S. Pat. No. 4,725,249 discloses another communications outlet in which module connections are made by slotted plates.

SUMMARY OF THE INVENTION

This invention relates to a wall box assembly for use with electrical cables disposed behind wall panels in frame structure. A mounting bracket having a peripheral frame is attached to studs prior to installation of the wall panels. A wall box having a peripheral flange can be inserted through a hole in the wall panel with the peripheral flange being flush with the exterior surface of the wall panel and aligned with the peripheral frame on the mounting bracket. Screws can be used to attach the peripheral flange to the peripheral flange. In this position any components inserted into the box from the front or cables attached to the rear of the box are located relative to the peripheral frame on the wall box and need not be precisely positioned relative to any part of the mounting bracket attached to the studs.

This wall box assembly is especially suitable for use in intelligent wiring systems using hybrid ribbon cables containing both power and signal wires. The cable can be precisely positioned relative to the rear of the wall box and modules used in the intelligent wiring system can be inserted into the front of the wall box and can be precisely positioned relative to the front of the box and thus relative to the exterior surface of the wall.

A convenience outlet assembly of this type can be used to interconnect power and associated signal wires in the hybrid ribbon cable to external components or position outlets to which appliances or other equipment can be attached. Other outlets such as coax and telephone which are not associated with the hybrid cable and also be positioned in this convenience outlet assembly.

The preferred embodiments of the convenience outlet assembly include a cable tap and a cable clamp. In one embodiment a portion of the cable tap is part of the outlet box with bus bars being located in the cable tap which comprises the rear wall of the box. At least a portion of the cable tap housing can comprise an integral part of the box.

DETAILED DESCRIPTION OF THE PREFERRED EMBODIMENTS

Figure 1:
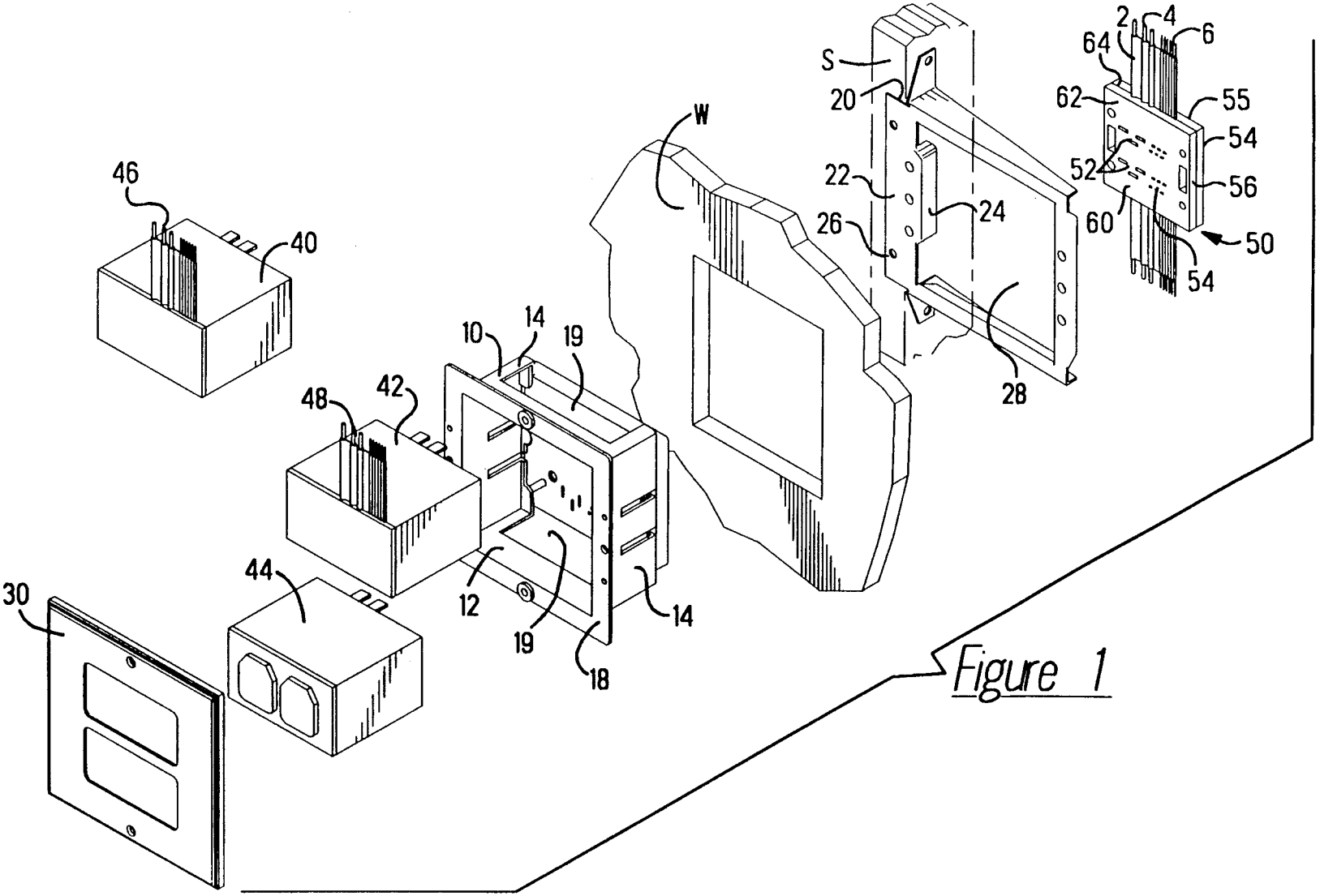
FIG. 1 is an exploded view of the first embodiment of the convenience outlet assembly.

The first embodiment of the convenience outlet assembly comprising the first embodiment of this invention is intended for use with a simplified cable tap which includes the capability of providing a socket interface for relatively large conductors, such as twelve to fourteen gauge wires 4 and relatively smaller conductors, such as twenty-four gauge wires 6. This convenience outlet assembly includes a mounting bracket 20, an outlet box 10 and a faceplate which can be attached to the outlet box 10. The mounting bracket 20 includes a frame 22 having a centrally located opening 28 and a plate 24 extending rearwardly from the frame 22 and at right angles to the frame 22. The plate 24 comprises means for attaching the mounting bracket 20 to a stud in a frame structure prior to installation of wall panels W over the studs S.

In the first embodiment of this invention the mounting bracket frame 22 extends completely around the central opening 28. It should be understood, however, that the frame 22 need not necessarily extend completely around this opening 28. Also in the first embodiment of this invention, the plate 24 used to mount the mounting bracket 20 on a stud comprises a section folded rearwardly from one side of the frame 22 and the material used to form the mounting plate 24 comprises the material that would otherwise have been removed to form the opening 28 between the sides of the frame 22. The mounting plate 24 has a conventional tab struck out from the mounting plate 24 and is configured to receive a fastener such as a nail to attach the mounting bracket 20 to a wooden stud. A plurality of holes are positioned along the side edges of the frame 22 generally adjacent the opening 28 in the frame 22. Additional holes are provided along the side of the frame 22 to which the mounting plate 24 is attached. These holes located along the outer edge of this side are intended to permit attachment of the mounting plate 24 to the edge of the stud.

A box 10 of the type used in the first embodiment of this convenience outlet assembly could be fabricated of either sheet metal or a plastic material, although a plastic box 10 is preferred with the specific embodiment shown. In the firs embodiment of this invention, the box 10 has four sides 14 which define an open front face 12 and an open rear face. A flange 18 extends around the box 10 on the front face 12 thereof. This flange 18 protrudes outwardly from the four sides 14 of the box 10, and in the first embodiment of this invention the flange 18 extends on all four sides 14. A plurality of holes are located in the flange 18. The pattern of these holes in the flange 18 corresponds to the pattern of holes adjacent the inner edges of the four sides of the frame 22 on the mounting bracket 20. The dimensions of the box 10 are such that the box 10 can be inserted through the opening 28 in the frame 22 and the holes in the flange 18 can be aligned with the mounting holes in the frame 22. Screws extending through the aligned holes secure the frame 22 to the flange 18.

A faceplate, having openings adapted to receive any of a plurality of socket configurations of either conventional or unconventional configuration. This faceplate not only provides a decorative cover but also provides means for physically securing components with the box 10. The faceplate is attached to the flange 18 simply by screws aligned with corresponding holes in both the faceplate and the flange 18.

The first embodiment of the convenience outlet assembly depicted herein is intended for use with wiring system in which both electrical power and electrical data signals are available in the convenience outlet assembly. The first embodiment of the convenience outlet assembly is intended for use with a hybrid ribbon cable 2 containing both power conductors, such as twelve to fourteen gauge conductors suitable for delivering fifteen to twenty amps and data or signal conductors, typically twenty-four gauge conductors, are located within a single insulated hybrid ribbon cable 2. The hybrid cable 2 is the type which can be employed for closed-loop and programmed power distribution a provided by Article 780 of the National Electric Code. A cable tap of the type disclosed in U.S. patent application Ser. No. 07/400,315 filed Aug. 28, 1989, incorporated herein by reference, is employed to provide sockets in a specified pattern for interconnection to the power and signal terminals in the hybrid ribbon cable 2. It should be noted that fewer conductors are employed in the hybrid ribbon cable 2 depicted herein than in the aforementioned disclosure and therefore fewer sockets will be needed in the cable tap depicted herein. In the first embodiment of this invention, this cable tap is configured for receipt in the open rear face of the box 10. When positioned in the open rear face of the box 10, this cable tap will essentially close the rear face of the box 10.

Various modules or blocks providing access to components from the convenience outlet assembly are configured for receipt in the box 10. These modules have plugs or male contacts configured for engagement with the sockets in the socket pattern of the cable tap. Any number of types of modules can be provided for interconnection to standard or intelligent components or for interconnection to separate cables 2 leading to components such as thermostats or security sensors located within a frame structure. After the cable tap is positioned in the rear of the box 10, desired modules can be inserted through the front face 12 of the box 10 with the appropriately configured plugs on the rear of the modules engaging the sockets and the cable tap. Modules such as duplex power modules must be aligned with the opening in the faceplate to provide for safe and aesthetic interconnection of plugs to the duplex power module.

The convenience outlet assembly and modules to be housed therein, can be assembled in the following manner. During initial construction of the frame structure, mounting brackets 20 can be nailed to studs S at desired locations within the structure. The wiring, such as the hybrid cables 2, can in turn be deployed in the frame structure. The cable taps depicted in this first embodiment comprise a cable clamp and a separate tap subassembly, both of which are of the type depicted in the aforementioned disclosure. Cable taps can be attached to the conductors at the location of the mounting brackets 20 at this time or cable taps can be subsequently attached when the convenience outlet assembly is assembled. Alternatively the cable clamp can be assembled to the cable 2 when the wires are deployed and the separate tap subassembly can be attached to the cable clamp when the convenience outlet assembly installation is completed.

The cable 2 extends behind the frame 22 of the mounting bracket 20. When wall panels W such as dry wall are mounted to the studs S in the frame structure, the location of the mounting brackets 20 can be noted and holes can be provided communicating with the opening 28 in the mounting bracket 20 in the conventional manner. When subsequent assembly of the convenience outlet assembly is desired, the hybrid ribbon cable 2, or the cable tap can be pulled through the opening 28 for assembly to the box 10. Of course, appropriate slack must be provided to permit cable 2 to be pulled through the opening 28 for assembly purposes. If a cable tap had not been previously attached to the hybrid ribbon cable 2, it can be attached at this time. Once the cable tap has been assembled, it can be inserted into the rear of the box 10 and secured to the box 10 thus closing off the rear of the box 10. At this point the box 10 can be attached to the frame of the mounting bracket 20. Note that the flange 18 on the box 10 will be positioned flush with the exterior of the panel which has previously mounted overt he mounting bracket 20. The frame and flange 18 are now aligned and when screwed together will trap the drywall in between, squeezing the drywall and forming a tight interface. Significantly, the location of the frame is keyed to the exterior of the wall panel and the position of the cable tap attached to the rear of the box 10 is also precisely located relative to the front of the wall panel and relative to the front of the frame of on the box 10. Either before or after the box 10 has been attached to the mounting bracket 20, appropriate modules can be inserted into the box 10 into engagement with the cable tap. Note that the individual module, have a precise length which corresponds to the space in between the front face 12 of the box 10 and the front face 12 of the cable tap attached in the rear of the box 10. Note that this dimension will not vary with respect to the position of the box 10 relative to the wall panel or the point at which the mounting bracket 20 is attached to the stud. The front face 12 of the box 10 is the reference surface for the entire assembly. Therefore it is always possible to insure that the modules are fully connected to the cable tap and or properly positioned with respect to the front face 12 of the box 10. After the modules have been inserted into the box in this manner, the faceplate can be attached and the assembly of the first embodiment of a convenience outlet assembly is complete.

Figure 2:
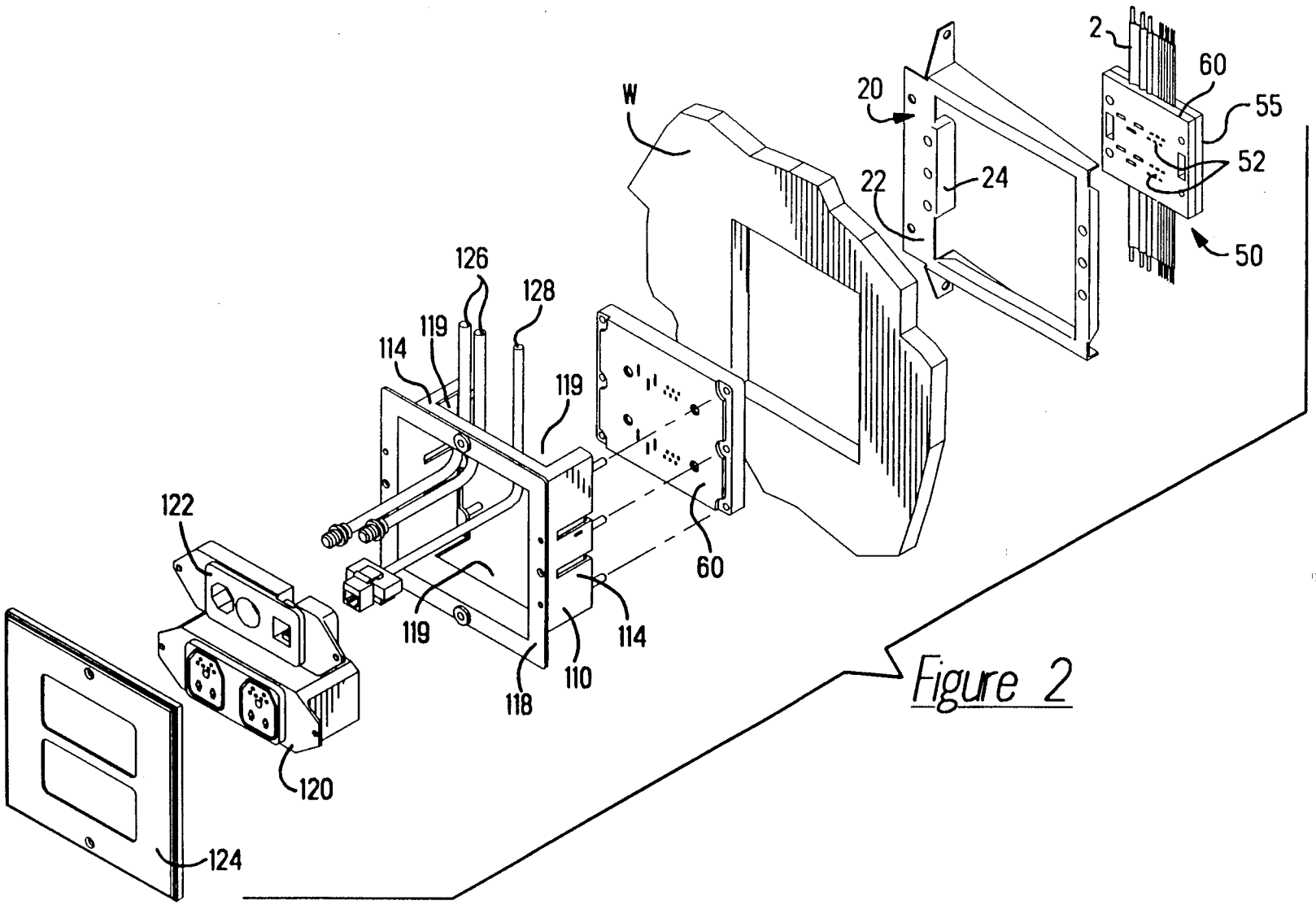
FIG. 2 is an exploded view of the second embodiment of the convenience outlet assembly.

A second embodiment of a convenience outlet assembly is depicted in FIG. 2. In this second embodiment, interconnection is provided for power, telephone and for a coax distribution system. This second embodiment also includes a mounting bracket 20, the cable clamp 55 of the second embodiment are the same as the corresponding items depicted in the first embodiment. The mounting box 110 differs from the previous embodiment in that two access ports 119 are provided on both the top and bottom sides of the box 110. These access ports 119 provide for entry of both coax and telephone conductors 126, 128, or for that matter for other types of conductors cables, on either or both the top and the bottom of the box 110. The box 110 of the second embodiment also has an extension on one side which may be received in a corresponding recess on the housing 60 of the cable tap 50 to properly orient the cable tap 50 with respect to the box 110. Proper orientation is necessary so that the modules 120, 122 used in this assembly can be properly oriented. In the second embodiment, a coax/telephone module housing 122 is provided which comprises a means for mounting standard coax and telephone jack configurations in the box 110. This coax/telephone module housing 122 does not provide for interconnection to the hybrid cable 2 nor does it form any portion of the electrical path of either the coax signal distribution system or coax conductors 126 or the telephone distribution system or the telephone cable 128. The duplex power module 120 depicted for use in this second embodiment includes means for mounting the duplex module directly to the box 110. Note, however, that proper positioning of duplex power module 120, relative to the cable tap 50, is still important so that male contacts or plugs on the rear of the duplex power module 120, relative to the cable tap 50, is still important so that male contacts or plugs on the rear of the duplex power module 120 properly engage sockets aligned with apertures 52 on the cable tap 50. The assembly of the second embodiment can be completed in the same manner as the first embodiment with the exception of the fact that the coax and telephone cables must be separately deployed and terminated.

A third embodiment, comprising a modification of the second embodiment, can also be employed. The cable tap subassembly can be included as a part of the box 210. By including the cable tap in the box, thus forming the rear wall of the box 210, the entire box 210 can be interconnected to the cable clamp 55, either before or after the cable clamp 55 is attached to the cable 2.

Figure 3:
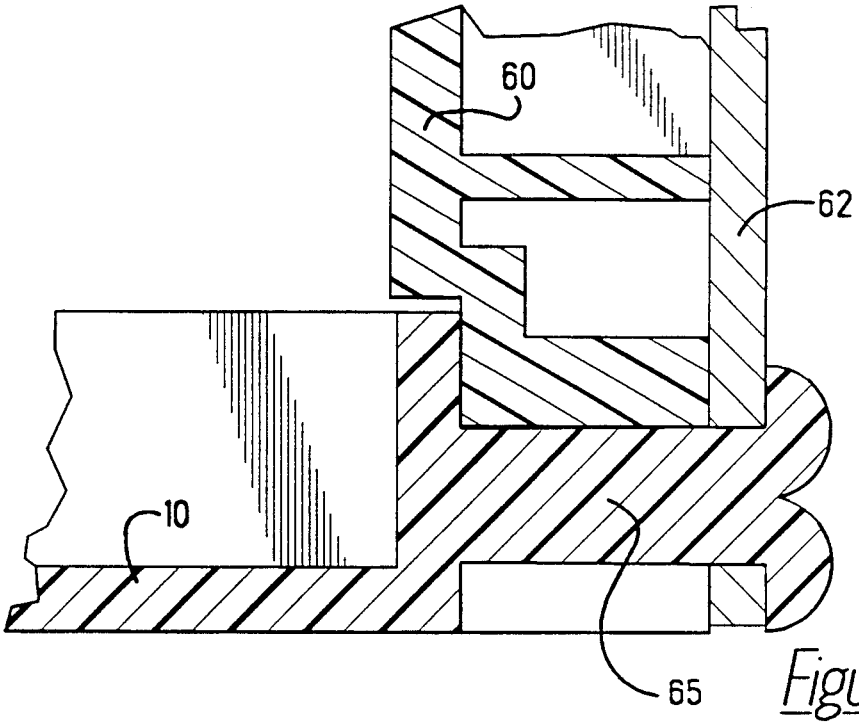
FIG. 3 is a partial view showing one means of attaching the cable tap to the back of the wall box.
Figure 4:
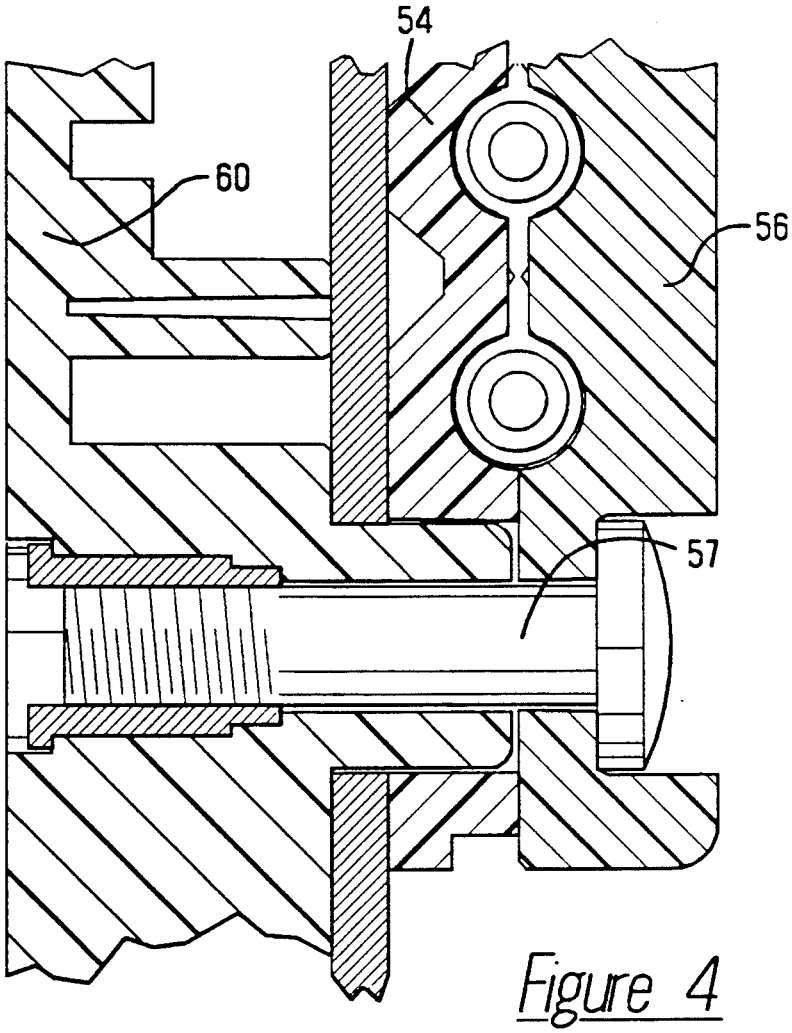
FIG. 4 is a partial view showing one means of attaching the cable clamp to the cable tap shown attached to the rear of the wall box in FIG. 3.
Figure 5:
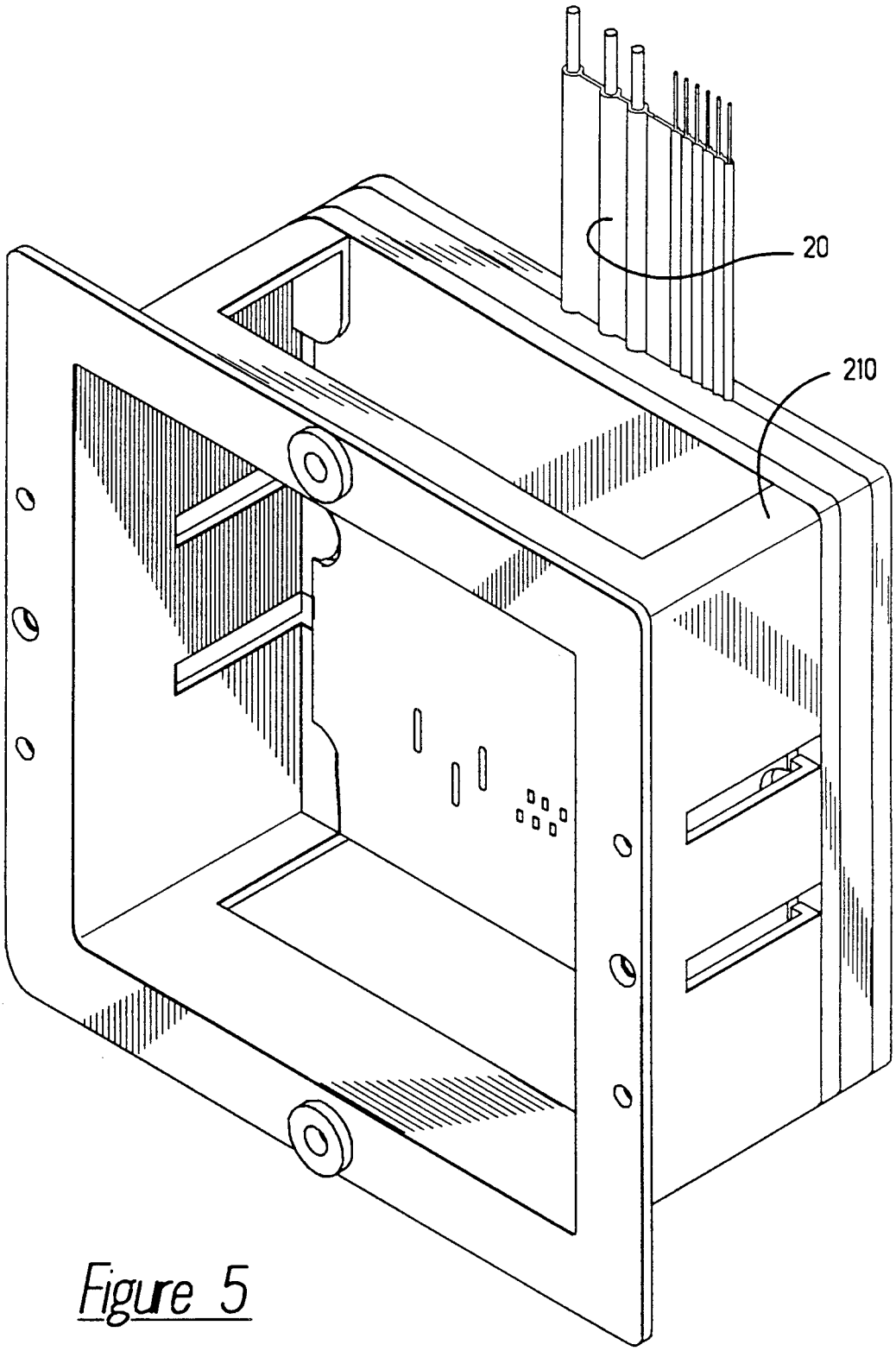
FIG. 5 is a view of the embodiment in which the front cable tap housing comprises an integral part of the wall box.
Figure 6:
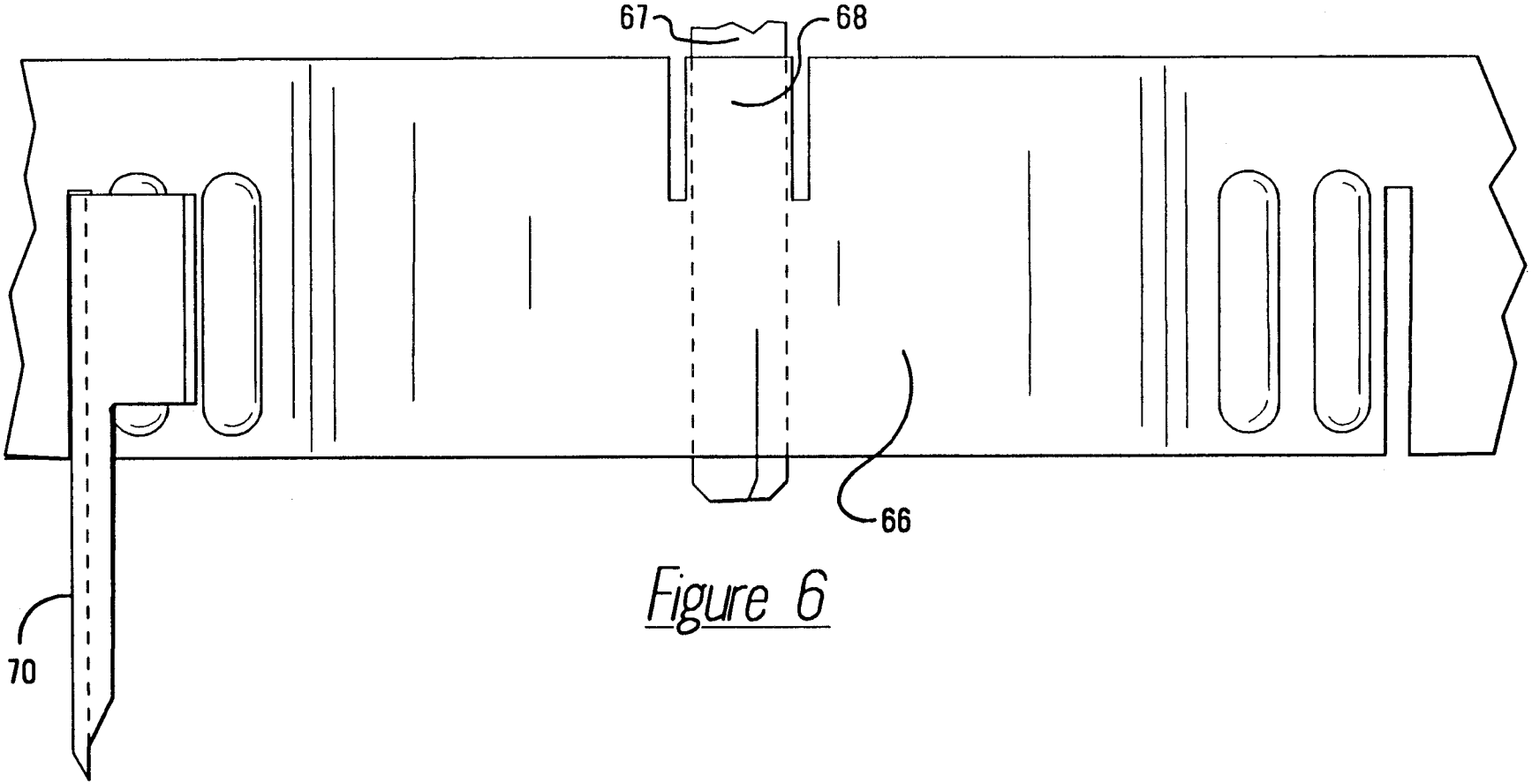
FIG. 6 is a plan view of a suitable bus bar for use herein.

FIG. 3 shows a version of the third embodiment in which the main cable tap housing 60 and the cable tap housing cover 62 are attached to the rear of the box by means of a heat staked post 65. Bus bars of the type depicted in U.S. patent application Ser. No. 07/399,740 filed Aug. 28, 1989, are positioned between the main cable tap housing 60 and the cable tap housing cover 62. FIG. 6 shows a bus bar 66 suitable for use in the cable tap. Bus bar 66 is intended for use with signal circuits and signal wires 6. Bus bar 66 comprises a folded plate having a socket contact section 68 facing in the forward direction in alignment with apertures 52 when positioned in the cable tap 50. Socket contacts 68 engages a male contact 67 extending from a module positioned within the box. This socket contact is formed between two parallel plates as described in the aforementioned disclosure. A second contact 70 extends rearwardly from the bus bar 66 and has a slotted plate at its rear end, in the manner disclosed in the aforementioned disclosure, to establish an insulation displacement contact with wires in cable 2 positioned within cable clamp 55. A bus bar subassembly suitable for use with the larger wires 4 in cable 2 is described in the aforementioned disclosure. It should be understood that the mounting box 10 could also be fabricated with the main cable tap housing comprising an integral part of the box as shown in FIG. 5. The bus bars can then be assembled on the exterior of the box 10. A separate cover could then be attached or the cable clamp housing could comprise a rear enclosure for the bus bars when the cable clamp is attached to the box. It should also be understood that the box need not have four sides and a box or frame could be employed in which one or more panels or arms extend between the cable tap and the peripheral flange. FIG. 4 shows one means of attaching mating cable clamp sections 54, 56 of the cable clamp 55 to the cable tap housing 60 by pin 57. This configuration can be employed when the cable tap subassembly is part of the box or is separate from the box.

Although this invention is depicted with respect to a first and second embodiments employed with hybrid ribbon cables 2, it should be understood that this invention is suitable for use with standard wiring, including standard house wiring. Indeed the instant invention could simplify standard wiring practices by eliminating rework when holes are improperly cut in drywall and by eliminating the need to insert large boxes through holes in drywall. Means can be provided for positioning the cables 2 and any interconnecting devices on the rear of the housing. The interconnecting devices, such as standard duplex receptacles can then be precisely positioned relative to the front flange of the box and also relative to the exterior of the wall panel. Thus a box can be positioned relative to the exterior of the wall panel and relative to the faceplate. As with the more sophisticated intelligent wiring systems of the firs and second embodiments, this conventional wiring approach will insure a more aesthetic and a safer installation as part of original construction.

We claim:

1. A wall box assembly for use in an electrical distribution system of a residential type construction, said assembly including at least one electrical cable disposed behind wall panels secured to studs of said construction, including:

a mounting bracket comprising a frame having an opening therein and means for attaching the mounting bracket to one of the studs prior to installation on the wall panels over the studs;

a box having an open front face and means for attaching the cable at the rear of the box, the box including a flange on the front face, said box further including means for positioning the cable parallel to said front face of the box so that electrical components can be inserted through said open front face and plugged into electrical contact with the cable;

and means for attaching the flange to the frame with the flange being positioned on a front surface of one wall panel and the frame being positioned on the rear surface of the wall panel, whereby electrical components can be positioned in the box and the box can be positioned flush with the front surface of the wall panel and can be attached to the stud by the mounting bracket.

2. The wall box assembly of claim 1 wherein the means for attaching the cable at the rear of the box comprises means for attaching a through cable.

3. The wall box assembly of claim 1 wherein the means for attaching the mounting bracket to one of the studs comprises a plate extending at a right angle relative to the frame.

4. A wall box assembly for use in an electrical distribution system of a residential type construction, said assembly including at least one electrical cable disposed behind wall panels secured to studs of said construction, including:

a mounting bracket comprising a frame having an opening therein and means for attaching the mounting bracket to one of the studs prior to installation of the wall panels over the studs;

a box having an open front face and means for attaching the cable at the rear of the box, the box including a flange on the front face, where said flange extends from four sides of the wall box, at least one of the sides having an opening through which auxiliary cables can extend;

and means for attaching the flange to the frame with the flange being positioned on a front surface of one wall panel and the frame being positioned on the rear surface of the wall panel, whereby electrical components can be positioned in the box and the box can be positioned flush with the front surface of the wall panel and can be attached to the stud by the mounting bracket.

5. The wall box assembly of claim 4 wherein the flange extends from four sides of the box, the size of the four sides of the box being less than the size of the opening.

6. A convenience outlet assembly for interconnecting electrical components to wires in a flat cable extending behind a wall in a structure, the assembly comprising:

a mounting bracket secured to a structural support behind the wall, the mounting bracket having a peripheral frame;

a cable clamp comprising means for positioning the plurality of wires in a prescribed orientation;

a cable tap subassembly attachable to the cable clamp;

a mounting box, separate from the mounting bracket, having an open front face with a peripheral flange on the front of the mounting box, the peripheral flange being attachable to the peripheral frame with the peripheral flange on the exterior of the wall and the peripheral frame being on the interior of the wall, the mounting box being insertable through an opening in the wall, the cable tap subassembly being mountable on the rear of the wall box; and at least one module insertable into the front of the wall box for attachment to the cable tap subassembly.

7. The convenience outlet assembly of claim 6 wherein the cable tap comprises means for positioning a hybrid ribbon cable having wires of at least two different gauges in a prescribed orientation.

8. The convenience outlet assembly of claim 6 wherein the cable tap subassembly encloses the rear of the wall box.

9. The convenience outlet assembly of claim 6 wherein the mounting box has four sides, at least one of the sides having openings through which a plurality of auxiliary cables extend.

10. The convenience outlet assembly of claim 9 wherein the auxiliary cables are attached to modules which are connected to the cable tap subassembly.

11. The convenience outlet assembly of claim 10 wherein the auxiliary cables are attached to modules which are separate from the cable tap subassembly.

12. The convenience outlet assembly of claim 6 wherein the cable tap subassembly comprises a housing and a plurality of bus bars positioned in the housing.

13. The convenience outlet assembly of claim 12 wherein at least part of the cable tap subassembly housing comprises a part of the mounting box.

14. The convenience outlet assembly of claim 13 wherein the part of the cable tap subassembly housing comprising a part of the mounting box comprises part of a one piece member including a plurality of sides of the wall box.

15. The convenience outlet assembly of claim 13 wherein the cable tap subassembly housing comprises a main housing which is attached to the mounting box and a cover which is attached to the main housing, but conductors being positioned between the main housing and the cover.

16. A wall box for mounting electrical components to be interconnected to wires, the wall box having four sides and being open on the front and having a rear wall extending between the four sides, a plurality of electrical interconnecting elements mounted on the rear wall, each interconnecting element having at least one first contact and at least one second contact, each first contact facing forward and each second contact facing rearward, the first contacts being offset from the second contacts, the rear wall of the wall box having apertures aligned with one of the first and second contacts so that components can be inserted into the interior of the wall box through the front and connected to the first contacts, and wires can be attached to the exterior of the wall box by connecting the wires to corresponding second contacts to connect the components to the wires through the interconnecting elements mounted on the rear wall of the wall box.

17. The wall box of claim 16 wherein the second contacts comprise insulation displacement contacts.

18. The wall box of claim 16 wherein the interconnecting elements comprise bus bars.

19. The wall box of claim 18 wherein each bus bar has a plurality of spaced apart first contacts aligned with corresponding apertures.

20. The wall box of claim 19 wherein the second contacts comprise insulation displacement contacts attachable to the bus bars.

* * * * *